United States Patent [19]

Wyslouzil et al.

[11] Patent Number: 4,571,473

[45] Date of Patent: Feb. 18, 1986

[54] MICROWAVE APPLICATOR FOR FROZEN GROUND

[75] Inventors: Walter Wyslouzil, Gloucester; Satish C. Kashyap, Kanata, both of Canada

[73] Assignee: Canadian Patents & Development Limited-Societe Canadienne des Brevets et d'Exploitation Limitee, Ottawa, Canada

[21] Appl. No.: 620,669

[22] Filed: Jun. 14, 1984

[30] Foreign Application Priority Data

Jun. 14, 1983 [CA] Canada ..... 430349

[51] Int. Cl.[4] ..... H05B 6/72

[52] U.S. Cl. ..... 219/10.55 A; 219/10.55 F; 219/10.55 R; 343/767; 343/770

[58] Field of Search ..... 219/10.55 A, 10.55 F, 219/10.55 R, 10.57; 343/720, 767, 768, 770, 771

[56] References Cited

U.S. PATENT DOCUMENTS

| | | | |
|---|---|---|---|
| 3,230,957 | 1/1966 | Seifert | 219/10.55 R X |
| 3,263,052 | 7/1966 | Jeppson et al. | 219/10.55 A |
| 3,829,649 | 8/1974 | Igarashi | 219/10.55 |
| 3,980,855 | 9/1976 | Boudouris et al. | 219/10.55 A |
| 3,988,036 | 10/1976 | Fisher et al. | 219/10.57 |
| 4,208,562 | 6/1980 | Perreault | 219/10.55 R |
| 4,217,477 | 8/1980 | Matsubara et al. | 219/10.55 B |
| 4,221,948 | 9/1980 | Jean | 219/10.55 A |
| 4,370,534 | 1/1983 | Brandon | 219/10.55 A |
| 4,370,535 | 1/1983 | Noda | 219/10.55 B |
| 4,399,341 | 8/1983 | Yasuoka | 219/10.55 R |

FOREIGN PATENT DOCUMENTS

| | | |
|---|---|---|
| 1044331 | 12/1978 | Canada . |
| 927901 | 5/1982 | U.S.S.R. . |

OTHER PUBLICATIONS

"Review of Thawtron TM Device for Thawing Frozen Coal," Mar. 1982, prepared by SRI Intl., Menlo Park, CA; Principal Investigators W. A. Edson and G. E. Tallmadge.

*Primary Examiner*—Philip H. Leung

[57] ABSTRACT

A microwave applicator for heating materials with microwaves. A coaxial transmission line is inserted in the material and coupled at one end to a source of microwaves. A shorting plate covers the other end of the cable and a plurality of radiating apertures are provided along the outer conductor. The use of a coaxial line avoids the minimum size requirements present with hollow waveguides. The coaxial line may be directly coupled to the output probe of a microwave generator by means of spring-finger contacts on the inner conductor of the coaxial line.

9 Claims, 2 Drawing Figures

MICROWAVE APPLICATOR FOR FROZEN GROUND

BACKGROUND OF THE INVENTION

1. Field of the Invention

This invention relates to apparatus for subjecting materials to microwaves, and more particularly, to a novel applicator for insertion into a material in order to radiate microwave energy into the material.

2. Description of Related Art

Various applicators for use in heating materials with microwaves are known. For example, C.P. No. 1,044,331 issued Dec. 12, 1978 to Hamid discloses a microwave horn applicator which may be placed on frozen soil in order to thaw the soil. It is disclosed that, in thawing soil, the depth of microwave penetration is limited to about 2.5 inches for soil at −10° F. and to about 5 inches for soil at 20° F.

U.S. Pat. No. 4,339,648, issued July 13, 1982 to Jean discloses another applicator, a hollow slotted rectangular waveguide which may be inserted into a confined material in order that microwave energy may be radiated into the material. This has the advantage that the depth of penetration depends on the length of the applicator and not the depth of microwave penetration as with an applicator placed on the surface of the material. Further, the area of penetration is governed by the number and the spacing of the applicators. However, a disadvantage with a hollow waveguide of any configuration is that it must meet certain minimum dimensional requirements in order to propagate microwave energy. More particularly, one cross-sectional dimension of any hollow waveguide must be at least equal to half the wavelength of the microwave energy applied to the waveguide in order for microwave energy to propagate along the guide.

Specific microwave frequency bands have been allocated for industrial, scientific and medical use of microwaves. Of the allocated bands, 915 MHz±13 MHz and 2,450 MHz±50 MHz are common in the use of microwaves for heating purposes. Relatively inexpensive microwave generators exist for these frequencies.

At 915 MHz, microwaves have a one-half wavelength of about 6.3 inches and at 2,450 MHz a one-half wavelength of about 2.4 inches. If frozen ground is to be thawed by means of an insertable applicator, a hole must be provided in the frozen soil to accommodate the applicator. Such a hole may be drilled. For a viable industrial operation, the diameter or the required hole should not be greater than about 2 inches. Consequently, a hollow waveguide would not be suitable for this purpose.

The minimum dimensions of a hollow waveguide may be reduced by filling the guide with dielectric material. This, however, is an unacceptable solution to the minimum dimensional requirements because of the resultant power losses in the dielectric material.

In result, there is a need for an insertable microwave applicator for heating materials operating in at least the 915 MHz±13 MHz and 2,450 MHz±50 MHz bands and with an outside cross-sectional diameter not exceeding 2 inches. The invention herein provides such an applicator.

SUMMARY OF THE INVENTION

Briefly stated, the invention herein is an applicator for treating a material with microwave energy comprising a coaxial transmission line, at least one aperture in the wall of the outer conductor of the coaxial line, and means to couple the coaxial line to a source of microwaves.

DESCRIPTION OF PREFERRED EMBODIMENTS

Figure 1:
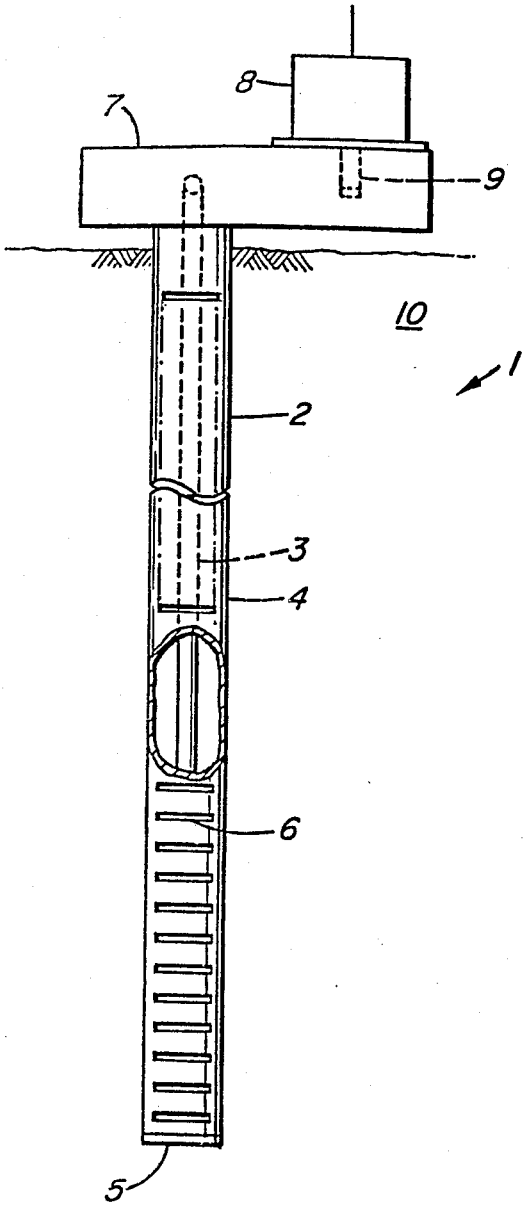
FIG. 1 is a schematic view of one embodiment of the applicator of this invention coupled to a microwave generator and inserted in the ground.

Turning to FIG. 1, the applicator is designated generally at 1. The basic element of the applicator is coaxial line 2. This line is 3½ feet in length and consists of an inner conductor 3 which is ½ inch in diameter and an outer conductor 4 with an outside diameter of 1½ inches and a wall 1/16 inch thick. An optional shorting plate 5 covers one end of the coaxial line, in order to support the inner conductor.

Apertures 6 are provided in the outer conductor. These apertures are aligned in two rows, diametrically opposite each other, each row having a common center line parallel to the axis of the applicator. The apertures are in the form of slots ⅛ inch wide and 1¼ inch long. In order to adapt the applicator to a microwave frequency of 2,450 MHz, the apertures are spaced 1.205 inches from center to center, which is one quarter wavelength at this microwave frequency. Thirty slots are provided in each of the two rows of the FIG. 1 embodiment, the first slots being spaced 1.205 inches from the shorting plate. In result, the uppermost slots are spaced approximately 6 inches from the end of the applicator remote from the shorting plate.

The outer conductor may be covered with a thin layer of low loss material (not shown) to prevent soil or other material from entering the applicator through the radiating apertures.

The end of the coaxial cable remote from the shorting plate terminates in hollow waveguide 7. More particularly, the outer conductor of the coaxial line terminates at the wall of waveguide 7 and the inner conductor extends into the waveguide in order to couple the coaxial line to the waveguide in a manner well known in the art. The output of a microwave generator 8 is coupled to the waveguide 7 at a point remote from the inner conductor of the coaxial line. As shown in FIG. 1, the output of the microwave generator 8 is output probe 9 which extends into the waveguide 7. For optimum operation with the applicator shown in FIG. 1, the generator should produce microwaves at a frequency of 2,450 MHz. The generator may, therefore, be a magnetron, such as an Amperex OM 72 which produces 800 W at 2,450 MHz.

In operation, the appropriate microwave generator is affixed to the waveguide 7 in order to couple the output of the generator to the waveguide. A hole is made in the soil 10 to be treated with microwaves, the hole having a diameter of about 2 inches and a depth of about 3'6". The coaxial line of the applicator/microwave generator assembly is then inserted into the hole. Thereafter the microwave generator is energized resulting in microwave energy at 2,450 MHz radiating from the output probe 9 and propagating along waveguide 7 and coaxial line 2. Microwave energy radiates from each of the slots 6 in the outer conductor and because of the ¼ wavelength spacing of these slots, internal reflections from the slots are minimized. Any microwave energy reaching the shorting plate 5 is reflected therefrom so that no energy radiates from the buried end of the coaxial line.

The heating pattern in the soil may be varied by changing the length of the coaxial cable and the size and distribution of the apertures. For example, apertures may be provided only along one side of the outer conductor, thereby limiting radiation to that side. Further, as will be obvious to those skilled in the art, the applicator may be adapted for heating materials other than frozen soil by choosing the appropriate length of the applicator, the frequency of the microwaves and the size and distribution of the apertures.

Figure 2:
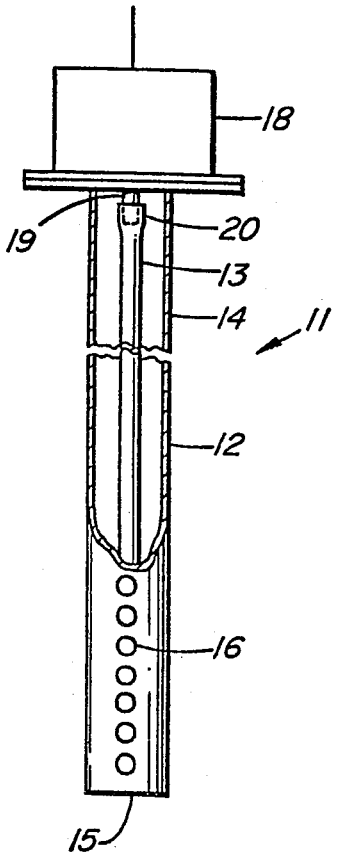
FIG. 2 is a schematic view of another embodiment of the applicator of this invention coupled to a microwave generator.

The versatility of the applicator/microwave generator assembly is enhanced with the ability to readily connect different applicators to a microwave generator. FIG. 2 illustrates an embodiment of this invention which facilitates the quick coupling and decoupling of an applicator to a microwave generator. In FIG. 2, the applicator 11 consists of a coaxial line 12 having an inner conductor 13 and an outer conductor 14. Circular apertures 16 are provided in the outer conductor. The coaxial line terminates at one end in shorting plate 15 and at the other end of the line, inner conductor 13 terminates in spring-fingers 20. The spring-fingers comprise resilient opposing conductive fingers which cooperate to engage output probe 19 of microwave generator 18. Output probe 19 supports an alternating currrent when the generator is energized. When the output probe of the microwave generator is engaged by the spring-fingers, the probe 19 and the inner conductor 13 are electrically connected. Thus, when the microwave generator is energized, the resulting alternating current in the probe is transmitted to the inner conductor 13, thereby propagating microwaves down the length of the applicator. In this way various applicators 11 are quickly connected to, or disconnected from, a microwave generator output probe.

While spring-fingers have been described, it will be plain to those skilled in the art that probe 19 may be electrically connected to inner conductor 13 with other quick connect/disconnect means.

We claim:

1. In an apparatus for thawing frozen ground by use of microwave energy a microwave applicator comprising a coaxial transmission line having an inner conductor, and an outer conductor, an array of regularly spaced apertures in the outer conductor, the distance between the centers of adjacent apertures being selected to minimize internal reflections and maximize radiation, a layer of low-loss material covering said apertures, means coupling the transmission line to a source of microwave energy; and a conductive plate covering the end of said transmission line remote from the source of microwave energy.

2. The applicator of claim 1, comprising a plurality of said apertures arranged in at least one row, the distance between the centers of the apertures of each said row being one quarter of the wavelength of the microwave energy to be coupled to said applicator.

3. The applicator of claim 2, wherein the outside diameter of said outer conductor does not exceed two inches.

4. The applicator of claim 2 wherein said means coupling said coaxial transmission line to a source of microwave energy comprises at least two opposing resilient members affixed to the end of the inner conductor of said coaxial transmission line not covered by said conductive plate adapted to releasably engage the output probe of a microwave frequency generator to provide an electrical connection between said inner conductor and said probe.

5. An applicator for thawing frozen ground by radiating microwave energy into a hole of about two inches diameter, comprising:

a coaxial transmission line having first and second ends and including an outer conductor of less than about two inches in diameter and about one-sixteenth inch in thickness, and including an inner conductor of about one-half inch in diameter, said transmission line being adapted for insertion into a ground hole for thawing the ground;

an array of regularly spaced apertures aligned in a row along said outer conductor, said array having a center line parallel to the axis of said transmission line, the distance between adjacent apertures in said array being selected in accordance with the frequency of the microwave energy to be radiated to minimize internal reflections and maximize radiation;

a layer of low-loss material covering said apertures;

coupling means at said first end of said transmission line for connecting said transmission line to a source of microwave energy; and conductive plate means covering said second end of said transmission line.

6. The applicator of claim 5, wherein said array of apertures includes two rows of apertures diametrically opposite each other, each row having a center line parallel to the axis of said transmission line.

7. The apparatus of claim 5, wherein the distance between the centers of the apertures in a row or said array is one quarter of the wavelength of the microwave energy to be radiated.

8. The apparatus of claim 7, wherein said array of apertures includes two rows of apertures diametrically opposite each other.

9. The apparatus of claim 8, wherein said coupling means includes at least two opposing resilient members affixed to said first end of said inner conductor of said transmission line and adapted to releasably engage an output probe of a microwave frequency generator.

* * * * *